US005094920A

United States Patent [19]

Shiozaki et al.

[11] Patent Number: 5,094,920

[45] Date of Patent: Mar. 10, 1992

[54] TELEVISION PICTURE TUBE INNER SHIELDING MATERIAL HAVING A BLACKENED LAYER OF SUPERIOR ADHESION AND METHOD OF MANUFACTURING THE SAME

[75] Inventors: Morio Shiozaki; Takayoshi Inokuchi; Masahiko Oda; Takahide Shimazu; Kazuo Nishiura, all of Himeji, Japan

[73] Assignee: Nippon Steel Corporation, Tokyo, Japan

[21] Appl. No.: 484,863

[22] Filed: Feb. 27, 1990

[30] Foreign Application Priority Data

Feb. 28, 1989 [JP] Japan ..... 1-48357

[51] Int. Cl.[5] ..... C21D 8/12; C23C 8/10

[52] U.S. Cl. ..... 428/472.1; 148/287

[58] Field of Search ..... 148/287; 428/472.1, 428/472.2

[56] References Cited

FOREIGN PATENT DOCUMENTS 60-255924 12/1985 Japan .

*Primary Examiner*—Jay H. Woo
*Assistant Examiner*—J. F. Durkin, II
*Attorney, Agent, or Firm*—Wenderoth, Lind & Ponack

[57] ABSTRACT

An inner shielding material and a method of manufacturing the same, wherein the material comprises a steel sheet 0.10 to 0.25 mm thick of a composition of ≦0.005% C, ≦2.0% Si, ≦0.4% P, 0.1 to 1.0% Mn, 0.01% S, ≦0.01% sol.Al, ≦0.01% N and the balance Fe and residual impurities, having a hardness $H_v$(500 g) of 90 or greater and a grain size of 7 or less when measured by ferrite grain size; and a blackened layer on the surface of the steel sheet comprising primarily FeO formed by transformation of $Fe_3O_4$ and having superior adhesion.

4 Claims, 3 Drawing Sheets

TEMPERATURE AND ATMOSPHERE PATTERNS, THIS INVENTION

TELEVISION PICTURE TUBE INNER SHIELDING MATERIAL HAVING A BLACKENED LAYER OF SUPERIOR ADHESION AND METHOD OF MANUFACTURING THE SAME

BACKGROUND OF THE INVENTION

1. Field of the invention

This invention relates to inner shielding material disposed laterally around the electron beams of a color television picture tube such that it covers the electron beams, and a method of manufacturing the same.

2. Description of the prior art

The basic structure of a color television picture tube comprises an electron gun and a phosphor screen which transforms the electron beams into an image. Furthermore, the inside of the tube is covered with magnetic shielding material which prevents deflection of the electron beams due to the earth's magnetic field. The magnetic shielding material comprises a mask frame, shadow mask inner shielding, outer shielding and the like. The properties required of a magnetic shielding material include high magnetic permeability in the earth's magnetic field (a weak magnetic field of approximately 0.3 Oe) and, also, a low coercive force $H_C$, which is necessary for improving the demagnetizing characteristics, specifically for reducing the number of turns of the demagnetizing coil and lower lowering its current. In particular, the inner shielding material disposed laterally around the electron beams inside a picture tube such that it covers the electron beams is particularly important as magnetic shielding material.

The material for the inner shielding is typically an extremely thin steel plate 0.10–0.25 mm thick, and this material (coil), after being press-worked by the electric equipment manufacturer, is subjected to magnetic annealing (700°–850° C.) if necessary and then a blackening treatment applied at a temperature of 550°–600° C., after which it is incorporated into the interior of the picture tube. The purpose of the blackening treatment is to improve the radiation of heat and prevent diffuse reflection of electrons.

However, in view of the expense of conducting two heat treatments (magnetic annealing and blackening treatment) electric equipment manufacturers are experimenting with omitting the magnetic annealing treatment to reduce costs, and one method of doing such is proposed in Japanese Published Unexamined Patent Application No. 60-255924. In this method, Al-killed steel sheet is tempered using skin pass rolling to coarsen the grains; the sheet is then subjected to strong cold rolling and a final blackening is used to recrystallize the sheet at the electric equipment manufacturer.

But blackening treatment carried out at the electric equipment manufacturer is expensive and in addition, blackening treatment done by the electric equipment manufacturer involves batch annealing after press working so the homogeneity of the blackened layer is a constant problem.

SUMMARY OF THE INVENTION

One object of the present invention is to eliminate not only magnetic annealing but also blackening treatment done by the electric equipment manufacturer, and thus provide an inexpensive inner shielding material.

Another object of the invention is to provide an inner shielding material of superior magnetic properties even if magnetic annealing done by the electric equipment manufacturer is omitted.

A still further object of the invention is to provide a method of fabricating inner shielding material which has a blackened layer of superior adhesion such that it does not peel off during blanking or other types of press working of the inner shielding material done by the electric equipment manufacturer.

DETAILED DESCRIPTION OF THE INVENTION

The main feature of this invention is the discovery of a steel sheet which has superior maqnetic properties and a tenacious blackened layer as an inner shielding material which allows the magnetic annealing and blackening treatments done by the electric equipment manufacturer to be omitted. First its magnetic properties will be described.

The inventors developed an inner shielding material which allows the magnetic annealing done by the electric equipment manufacturer to be omitted and which has such superior magnetic properties as a magnetic permeability of $\mu_{0.3} \leqq 750$ emu and $H_C \leqq 1.2$ Oe, while also being easy to handle.

Firstly, it has a large grain size of 7 or less, when measured by ferrite grain size (JIS G 0552, 1987), and secondly, no final cold rolling is done so no strain is applied to the raw steel sheet material. And thirdly, the hardness of the steel sheet is increased to a $H_V$(500 g) of 90 or greater by means of solid solution strengthening, thus solving such problems as pinching, roller dents, breaking and the like on the exit side of a continuous annealing line. At the same time, the shape of the raw product is improved, improving the ease of handling during press working and blackening treatment done by the customer.

The inventors first studied the composition, grain size and strain of the material.

Figure 1:
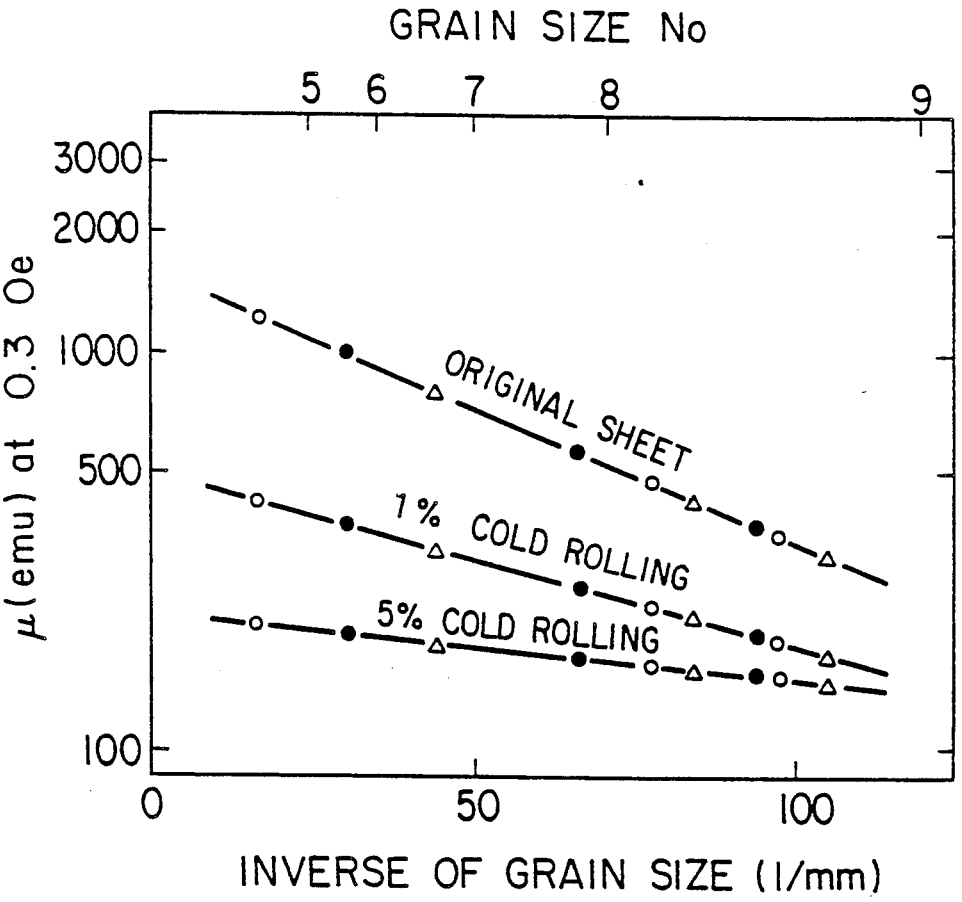
FIG. 1 is a graph illustrating the effect of grain size and cold rolling on magnetic permeability.

Specifically, steel of the composition shown in Table 1 was hot-rolled and then cold-rolled to a thickness of 0.15 mm, and then the characteristics of the steel plate were measured after soaking at 700°–1000° C. × 3 min of annealing. As is evident from FIG. 1, the content of Si, Al, C, etc. had no effect at a total content of less than 4%, but rather, the logarithm of magnetic permeability was dependent only on grain size which changes with the heat-treatment conditions, and varied linearly with the inverse of grain size.

Furthermore, the addition of several percent strain to the steel sheet caused degradation of the permeability. An identical tendency is evident for coercive force.

Therefore, in order to reach the objectives of $\mu_{0.3} \leqq 750$ emu and $H_C \leqq 1.2$ Oe, it is necessary to first coarsen the grains of the raw material for the inner shielding to a grain size of 7 or less and then avoid subsequent strain (rolling).

TABLE 1

(wt %)

| Sample | Si | sol.Al | C | Legend (FIG. 1) |
|---|---|---|---|---|
| A | 3.02 | 0.90 | 0.0020 | ○ |

TABLE 1-continued

| Sample | Si | sol.Al | C | Legend (FIG. 1) |
|---|---|---|---|---|
| | | | | (wt %) |
| B | 1.53 | 0.31 | 0.0332 | Δ |
| C | 0.001 | 0.01 | 0.0016 | ● |

In addition, steel sheet softened by high-temperature annealing to obtain large grain sizes is extremely difficult to handle so the hardness must be raised to above 90 (approximately 17 kg/mm$^2$ by yield point) by means of solid solution strengthening (precipitation hardening-type elements are not preferable due to their strong suppression of crystal grain size growth).

With regard to the composition, oxide inclusions ($Al_2O_3$, MnO, $SiO_2$, etc.) and precipitants (MnS, AlN, etc.) which suppress grain growth had best be reduced to as low levels as possible. Thus O, S, N and the like should be reduced. With the purpose of improving threading performance, appropriate amounts of Si, P and the like are added to give the steel sheet strength and rigidity.

The following is a description of the composition of the steel sheet.

The C content of the product material must be 0.005% or less from the standpoint of magnetic aging. Si is effective in increasing the hardness of the steel sheet, but the cost of addition becomes a problem if the content is too high, thus the Si content must be 2.0% or less. If the Mn content is less than 0.1% then fine precipitation of MnS occurs, impairing crystal grain growth, thus an Mn content of 0.1% or above is required. An excess of Mn makes cost a problem, so an upper limit of 1.0% is used. Note that Mn has the effect of increasing hardness, while not quite to the degree of P to be described hereafter. P is effective in increasing the hardness of steel sheet, but in excess of 0.4% causes fine graining due to segregation.

The objectives of the element addition for solid solution strengthening in the invention is to effectively prevent problems on the inner shielding material manufacturing line, specifically pinching, wrinkling, denting by the pinch rollers and the like; improve the form and also improve the handling of the product material done by the customer.

By raising the hardness $H_V$(500 g) of the steel sheet to 90 or above, these objectives are achieved. If the sol.Al content exceeds 0.01%, precipitation of AlN becomes excessive so an upper limit of 0.01% is preferable. Note that there is a method of adding 0.2% or more of sol.Al to enlarge AlN crystals and improve crystal growth, but this method is disadvantageous due to cost considerations so it is not employed. In addition, the S and N content should be low due to crystal growth considerations, so each is preferably 0.01% or lower.

With respect to hot rolling, there are no particular limitations, but the heating temperature of the slab is preferably low to suppress solid solution of the precipitates; if S and N are present in trace quantities they have little effect. In addition, the finishing temperature of hot rolling is preferably just below the Al transformation point (910° C. for pure iron), but even if the finishing is carried out on the high-temperature side, namely the γ-phase, there is no problem as long as processing is done at a slightly higher temperature during the final continuous annealing. The hot rolling take-up temperature is preferably slightly high at 650°-850° C. with the objective of crystal grain growth in the hot-rolled sheet.

The ensuing annealing of the hot-rolled sheet should best be carried out to obtain coarse grains in the final product, but it also may be omitted. Cold rolling, if carried out at a strong reduction, results in smaller grain sizes after the next recrystallization annealing; thus the cold reduction is preferably low and a sheet thickness of 3 mm or less is advantageous.

The final annealing temperature greatly affects crystal grain growth, so unless it is at least 750° C. or higher, a grain size of 7 will not be obtained. In addition, after soaking at a temperature above the Al transformation point, cooling at 300° C./min or faster will harden the steel and is thus advantageous from the standpoint of improving the rigidity of the steel sheet.

In addition, the final annealing must be carried out in a continuous furnace. This is because shape defects are common in batch furnaces when the temperature is raised to above 750° C. Thus temper rolling becomes necessary to straighten the shape of the material, making it impossible to obtain a high-performance shielding material, which is the object of the invention.

Note that the continuous furnace is required also for the purpose of the blackening treatment as described later.

Next the formation of a blackened layer of superior adhesion, which is another characteristic of the invention, will be described in detail.

Conventionally, the electric equipment manufacturer press-works inner shielding materials by blanking, beading and bending, and then subjects them to blackening treatment at near 600° C. in an atmosphere of a gas containing Nz and HzO with a dew-point temperature of 40° C., thus making them into parts for television. The composition of the blackened layer is $Fe_3O_4$. Commonly known blackening treatment techniques include the method of blackening treatment by means of a heat-treatment and cooling process such as that disclosed in U.S. Pat. No. 2,543,710 and the method of carrying out the blackening process over a cycle of the entire heat-treatment process as disclosed in Japanese Published Unexamined Patent Application No. 63-161126. However, the blackened layers of both of these techniques have problems with peeling during press working. For this reason, the blackening treatment after press working could not be omitted.

Table 2 lists the results of experiments to determine the structure of the oxide layer.

As the material, a cold-rolled steel sheet having a composition of 0.003% C, 0.01% Si, 0.35% Mn, 0.008% S, 0.007% Al and 0.002% N was used. This sample was first heat-treated at 600° C. for 30 seconds, then immediately heat-treated at 800° C. for 30 seconds and cooled at a rate of 40° C./sec.

The structure of the oxide layer was examined by x-ray analysis using samples cooled at various stages.

The degree of blackness was evaluated visually, so since $Fe_3O_4$ is bluish, FeO black and $Fe_2O_3$ reddish, those samples closest to black in color were marked with a ○. Adhesion was evaluated with respect to working, in that the samples were examined for peeling of the oxide layer after bending (to a radius of curvature of 0.5 mm) and beading (width: 5 mm, indentation: 3 mm).

TABLE 2

| Test number | Atmosphere 600° C. | 800° C. | Cooling | Changes in oxide layer composition | Black-ness | Adhe-sion | Remarks |
|---|---|---|---|---|---|---|---|
| 1 | Oxidizing | Not annealed | Non-Oxidizing | $Fe_3O_4$ | Δ | X | Comparative example (conventional example) |
| 2 | Non-Oxidizing | Non-Oxidizing | Oxidizing | $Fe_3O_4$ | Δ | X | Comparative example (conventional example) |
| 3 | Non-Oxidizing | Oxidizing | Non-Oxidizing | FeO | ○ | X | Comparative example |
| 4 | Oxidizing | Non-Oxidizing | Non-Oxidizing | $Fe_3O_4 \rightarrow FeO$ | ○ | ○ | Present invention |
| 5 | Oxidizing | Oxidizing | Non-Oxidizing | $Fe_3O_4 \rightarrow FeO$ | ○ | X | Comparative example |
| 6 | Strongly oxidizing | Strongly oxidizing | Non-Oxidizing | $Fe_3O_4 \rightarrow F_2O_3$ | X | X | Comparative example |
| 7 | Oxidizing | Non-Oxidizing | Oxidizing | $Fe_3O_4 \rightarrow FeO \rightarrow Fe_3O_4$ | Δ | X | Comparative example |

The following is a description of each experiment.

In experiment number (1), the heat-treatment conditions were very nearly the same as in the conventional blackening treatment method, so an oxide layer comprising mainly $Fe_3O_4$ was formed. When this steel sheet was subjected to bending and beading, the oxide layer peeled off from the worked sections. This is the reason why the blackening treatment could not be carried out before press working.

When using the method of oxidizing during cooling (number (2)) as is conventionally carried out, $Fe_3O_4$ layers were formed, but none had sufficient adhesion to withstand working.

In experiment number (3) where the formation of an oxide layer was prevented at 600° C. but oxidation was allowed at 800° C., a FeO layer was formed but the adhesion of the oxide layer was so poor that the oxide layer peeled off in flakes even with slight bending.

On the other hand, in number (4) according to the method of the invention, $Fe_3O_4$ which was formed once at 600° C. underwent a phase transformation at high temperature, forming an oxide layer comprised primarily of FeO on the steel sheet. This steel sheet exhibited no problem with peeling of the oxide layer even when subjected to bending and beading.

In experiment number (5) where oxidation was carried out at both 600° C. and 800° C., a FeO layer was formed, but part of the oxide layer had already begun peeling when the steel sheet sample was removed from the furnace. While $Fe_2O_3$ was also formed in an even stronger oxidizing atmosphere (number (6)), the adhesion of the layer was so poor that it could not be used.

Note that in experiment number (7), after oxidizing at 600° C., oxidation was prevented at 800° C., but oxidation was permitted during cooling so that part or all of the FeO formed at 800° C. was transformed to $Fe_3O_4$ due to oxidation during cooling so the target adhesion was not obtained.

As described above, a $Fe_3O_4$ oxide layer which is formed at low temperature and undergoes a phase transformation into FeO at high temperature and then is cooled without oxidation results in a FeO oxide layer which has the property of singularly superior adhesion after working, and also has a good degree of blackness.

Now these conditions will be clarified further and described in detail following the constituent requirements of the invention.

Note that the reason why $Fe_3O_4$ phase-transformed into FeO does not peel when subjected to deformation during working, the main point of the invention, is still unclear, but it is surmised to be an effect related to oxygen atoms emitted during transformation having formed holes.

First, oxidation of the steel plate is required over part or all of a temperature rise from 300° C. to 750° C., and the oxidation time is preferably 5-300 seconds. At lower than 300° C., the oxide layer is thin and uneven and the corrosion resistance drops. On the other hand, if 750° C. is exceeded, adhesion is degraded. Less than 5 seconds is too short of time for oxidation, preventing a homogeneous layer from forming. A too long of time presents virtually no problem from the standpoint of the quality of the oxide layer, yet 300 seconds is the upper limit imposed by economic considerations.

With respect to the oxidizing gas atmosphere, there are no particular limitations, but the following conditions are preferable.

As the oxidizing gas atmosphere, one to three of the following are employed: 0.2-21% $O_2$ by volume, 2-25% $CO_2$ by volume or $H_2O$ at a dew point of 10°-60° C., with the balance made up of $N_2$, Ar or another inert gas; reducing gases such as $H_2$ and CO are also possible. However, if $H_2$ and CO are present, then the volume ratio of $H_2O$ to $H_2$ should be greater than 0.25 or more and the volume ratio of $CO_2$ to CO should be greater than 1.2 for oxidation.

The limiting values for the quantities of $O_2$, $CO_2$ and $H_2O$ are all established because if any of the lower limits are exceeded the oxide layer will be too thin with an average thickness of less than 0.5 μm, degrading its corrosion resistance and also resulting in bare portions with no oxide layer. On the other hand, if the upper limits are exceeded, adhesion of the oxide layer to the an average thickness of less than 0.5 μm, degrading its corrosion resistance and also resulting in bare portions with no oxide layer. On the other hand, if the upper limits are exceeded, adhesion of the oxide layer to the iron substrate will be degraded, making peeling of the oxide layer likely to occur during press working. Note that attempting to control the $O_2$ content to exceed 21% means that $O_2$ gas must be introduced into the furnace, causing industrial difficulties, so 21% or less is preferable.

Industrially it is simplest to heat the furnace with a direct-fire burner so $O_2$, $H_2O$ and $CO_2$ can be used together. In this case, it is preferable that the volume of at least one of the three types of oxidizing gases be within the above percent range by volume.

As described above, the surface of the steel sheet is oxidized at 300°-750° C. to form $Fe_3O_4$, then the temperature must be raised further for it to transform to FeO. At this time, it is being annealed in a non-oxidizing atmosphere. This is because, if the steel sheet is additionally oxidized during soaking at high temperature above 750° C., the adhesion of the oxide layer is markedly degraded. Furthermore, a temperature of 650° C. or greater is required to transform $Fe_3O_4$ into FeO.

Here the non-oxidizing atmosphere is comprised primarily of $N_2$, Ar or another inert gas, while the oxidizing gases are preferably kept to less than 0 2% of $O_2$, $H_2O$ at a dew point of 10° C. or less, and less than 0.2% of $CO_2$. The atmosphere may contain $CO,H_2$ or other reducing gases but the volume ratio of $H_2O$ to $H_2$ should be less than 0.25 and the volume ratio of $CO_2$ to CO should be less than 1.2. The reason for this is to suppress additional oxidation at high temperature.

Note that depending on the structure of the continuous annealing furnace, there are cases in which, in order to isolate the atmospheres of the preheating zone and heating zone or heating zone and soaking zone, there are separate furnaces for each zone. In this case, there are times when the steel sheet comes into direct contact with the air atmosphere, albeit for short periods. As long as the temperature is below 750° C., what oxidation which may occur at this time causes virtually no problem.

The atmosphere during cooling must be the same non-oxidizing gas as during soaking to prevent oxidation. This is because the oxides which form during cooling are the $Fe_3O_4$ which has poor adhesion. Note that cooling speed also requires consideration, in that 10° C./sec or faster is preferable. If slower than 10° C./sec, then transformation back to $Fe_3O_4$ will occur.

However, when the atmosphere is adjusted to the above oxidizing gas composition, after the temperature of the steel sheet is raised to 300°-650° C. for 5-300 seconds, the sample was cooled to determine the structure of the oxide layer using x-ray analysis which revealed that 90% of the oxide was $Fe_3O_4$ (and the balance was FeO or $Fe_2O_3$).

Yet when a sample was then soaked in a non-oxidizing atmosphere at a temperature of 650° C. or more, the same X-ray analysis revealed that 80% of the $Fe_3O_4$ had transformed to FeO. When this FeO is rapidly cooled in a non-oxidizing atmosphere, the FeO which is the object of the invention is formed.

Steel sheet finished to 0.10-0.25 mm is given a final continuous annealing. In this final continuous annealing, an ultimate temperature of 750° C. or greater is required to bring the grain size up to 7 when measured by ferrite grain size (JIS G 0552). While 650° C. is sufficient for a tenacious blackened layer, in order to obtain a high-performance inner shielding material having a coercive force of 1.2 Oe or less, the grain size must be increased. In addition, the heat pattern and atmosphere must be strictly controlled as above to form an oxide layer able to withstand working.

Note that the surface hardness of steel sheet subjected to this blackening treatment is naturally improved in comparison to non-blackened steel sheet, so this black film is effective against denting, kinks, wrinkles and other problems at the pinch rollers on the exit side of the continuous annealing furnace.

Figure 2:
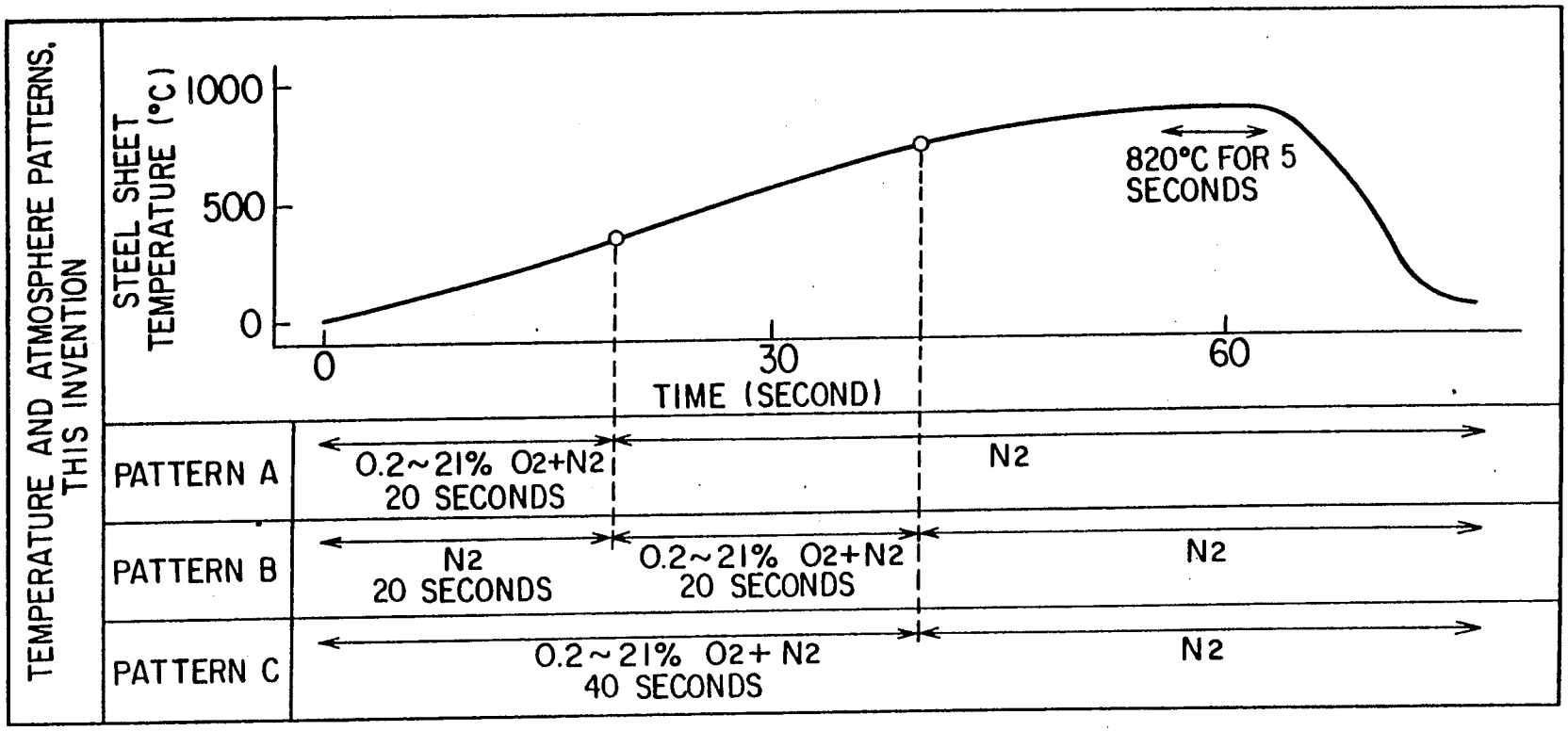
FIG. 2 is a diagram of a practical embodiment of formation of the blackened layer of the invention.

FIG. 2 schematically shows an example of a specific practical embodiment of the invention.

In pattern A, oxidation occurs until 350° C. and then further heating and cooling is carried out in $N_2$. In pattern B, oxidation occurs during only the temperature rise from 350°-750°, and the balance of the temperature range is in an $N_2$ atmosphere. In pattern C, oxidation occurs over the temperature rise up to 750° C. and then further heating and cooling is carried out in $N_2$.

Any of patterns A, B and C can be carried out to obtain steel sheet with an oxide layer of both excellent workability and corrosion resistance. Note that as the oxidizing gas, as described above, one to three of the following may be used: 0.2-21% $O_2$, 2-25% $CO_2$, or $H_2O$ at a dew point of 10°-60° C.

Note that the effect that the steel composition has on the formation/fabrication of the oxide layer may be ignored within the experimental range of Si content ≦4.0% and Al content ≦2.0%.

Figure 3A:
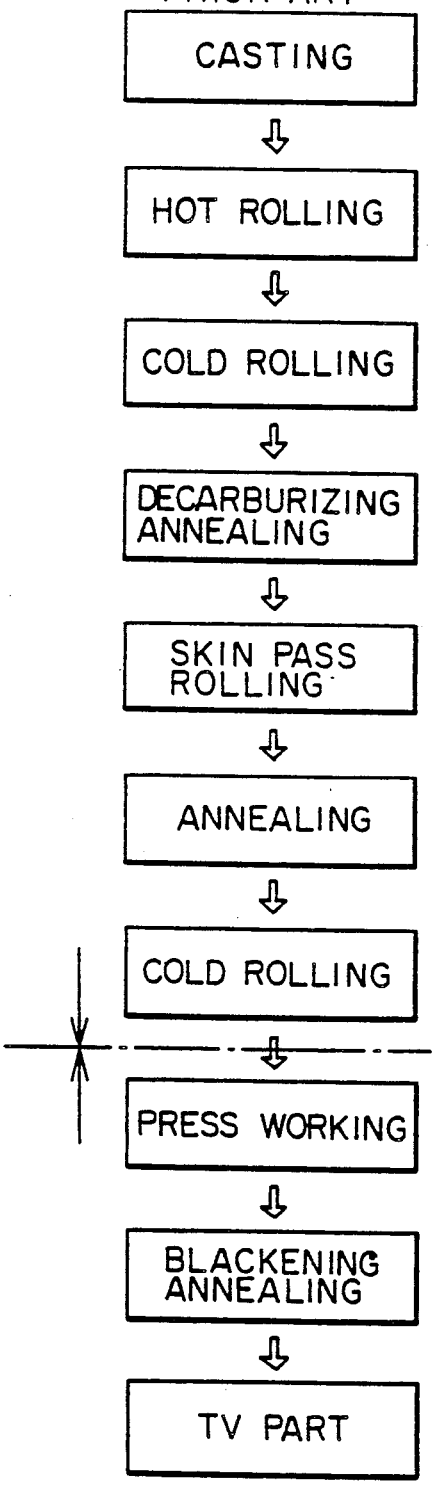
FIG. 3(a) PRIOR ART
FIGS. 3(*a*) and (*b*) compare the conventional process with the process of the invention.
Figure 3B:
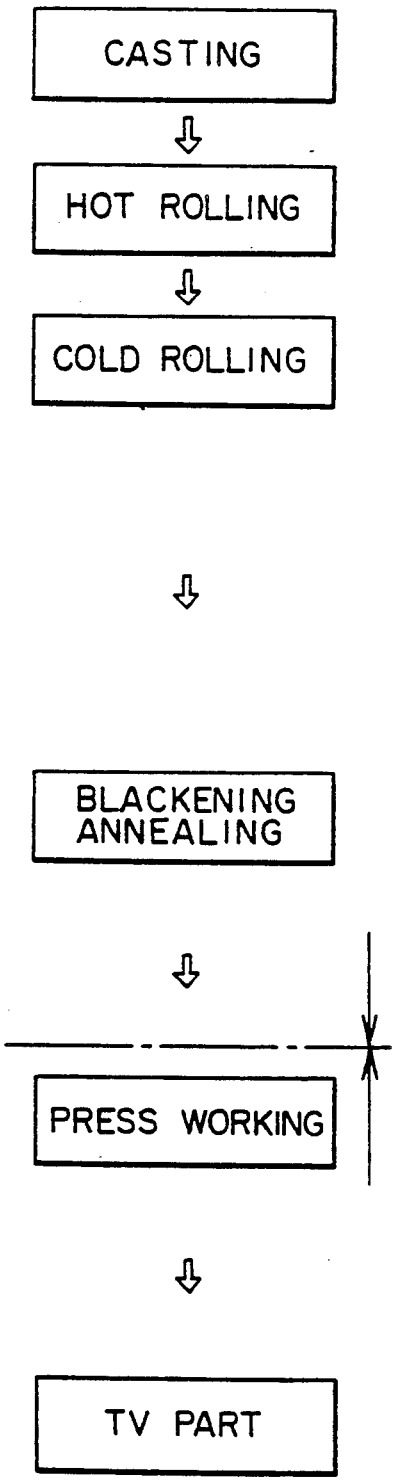

FIG. 3 is a diagram comparing the process (a) disclosed in Japanese Published Unexamined Patent Application No. 60-255924 against the process (b) of the present invention.

PREFERRED EMBODIMENT 1

Continuous-cast slabs of compositions variously altered at the steel-making stage (Table 3) were heated to 1200° C., treated at a finishing temperature of 860° C., take-up temperature of 700° C. and made into 2.5 mm hot-rolled sheets. Next they were cold-rolled to 0.15 mm. The final continuous annealing conditions comprised: time from room temperature to 560° C. of 30 sec, while the atmosphere during this time is 1.5% $O_2$, $H_2O$ at a dew point of 60° C., 12% $CO_2$ with the balance being $N_2$.

Next a soaking treatment is carried out at 800° C. for 50 seconds from heating to cooling, and then the plate is cooled at a rate of 15° C./sec. The atmosphere during this period is 3% $H_2$ with the balance being $N_2$.

The results of evaluating the properties of this material are tabulated in Table 4.

Note that the properties of sample ⑦ were evaluated after subjecting the final annealed sheet of sample ② to 1% temper rolling.

Measurement of permeability and coercive force was carried out using Epstein samples (JIS C 2550) with the permeability being measured with 0.3 Oe of magnetizing force, while the coercive force was measured after a maximum magnetizing force of 10 Oe. The oxide layer properties were evaluated using a corrosion-resistance test (two months in duration at room temperature) and an adhesion test (bending 90° to a radius of curvature of 0.5 mm) which were considered to pass (○) if no rust appears and no peeling appears, respectively.

TABLE 3

| Sample | C | Si | Mn | P | S | sol.Al | (wt %) N |
|---|---|---|---|---|---|---|---|
| ① | 0.004 | 0.08 | 0.7 | 0.02 | 0.004 | 0.008 | 0.0015 |
| ② | 0.003 | 0.25 | 0.3 | 0.12 | 0.003 | 0.002 | 0.0085 |
| ③ | 0.005 | 1.75 | 0.6 | 0.01 | 0.009 | 0.013 | 0.0020 |
| ④ | 0.002 | 0.001 | 0.3 | 0.41 | 0.002 | 0.001 | 0.0021 |
| ⑤ | 0.001 | 0.02 | 0.9 | 0.23 | 0.012 | 0.001 | 0.0018 |
| ⑥ | 0.004 | 0.15 | 0.1 | 0.33 | 0.001 | 0.002 | 0.0108 |
| ⑦ | 0.003 | 0.25 | 0.3 | 0.12 | 0.003 | 0.002 | 0.0085 |

Note: The underlined values are outside the range of the invention.

TABLE 4

| Sample | Grain size | Hv 500 g | μ Oe | Hc Oe | Product form | Oxide layer properties | Overall evaluation | Classification |
|---|---|---|---|---|---|---|---|---|
| ① | 6.2 | 91 | 930 | 1.08 | Good | ○ | ○ | This invention |
| ② | 6.7 | 99 | 810 | 1.16 | Good | ○ | ○ | This invention |
| ③ | 7.1 | 134 | 730 | 1.21 | Good | ○ | X | Comparative |
| ④ | 7.3 | 126 | 700 | 1.28 | Good | ○ | X | Comparative |
| ⑤ | 7.5 | 106 | 660 | 1.31 | Good | ○ | X | Comparative |

TABLE 4-continued

| Sample | Grain size | Hv 500 g | μ Oe | Hc Oe | Product form | Oxide layer properties | Overall evaluation | Classification |
|---|---|---|---|---|---|---|---|---|
| 6 | 7.2 | 119 | 710 | 1.26 | Good | ○ | X | Comparative |
| 7 | 6.7 | 131 | 300 | 2.05 | Good | ○ | X | Comparative |

Those samples with good permeability and coercive force have large crystal grain sizes. The target permeability of ≧750 emu and coercive force of ≦1.20 Oe are both achieved by samples 1 and 2 which satisfy the conditions of the invention. In addition all samples are good with respect to the oxide layer.

and 0.003% N by weight with the balance essentially iron was subjected to an experiment in which the continuous annealing conditions were varied.

The oxidizing gas atmosphere contained 3% $O_2$, $H_2O$ at a dew point of 40° C., 9% $CO_2$ and 0.3% CO with the balance $N_2$, and the cooling rate was approximately 50° C./sec.

TABLE 6

| No. | Oxidizing conditions during rising temperature: Temperature range (°C.) | Time (sec) | Rising temp.→Soaking→Cooling: Temp. (°C.) | → | Soaking (°C. × sec) | → | Cooling rate (°C./sec) | Atmosphere (Vol %) | Hc Oe | Oxide layer properties: Corrosion resistance | Adhesion | Overall evaluation | Remarks |
|---|---|---|---|---|---|---|---|---|---|---|---|---|---|
| 1 | RT~290 | 15 | 290 | → | 660 × 120 | → | 50 | 100$N_2$ | 1.82 | X | ○ | X | Comparative |
| 2 | RT~310 | 15 | 310 | → | 660 × 120 | → | 50 | 100$N_2$ | 1.82 | ○ | ○ | X | Comparative |
| 3 | RT~760 | 40 | 760 | → | 850 × 10 | → | 50 | 100$N_2$ | 0.97 | ○ | X | X | Comparative |
| 4 | RT~730 | 40 | 730 | → | 850 × 10 | → | 50 | 0.1$O_2$ + 99.9$N_2$ | 0.97 | ○ | ○ | ○ | Present invention |
| 5 | RT~730 | 40 | 730 | → | 850 × 10 | → | 50 | 0.3$O_2$ + 99.7$N_2$ | 0.97 | ○ | X | X | Comparative |
| 6 | RT~730 | 40 | 730 | → | 850 × 10 | → | 50 | 30$H_2$ + 70$N_2$ | 0.97 | ○ | ○ | ○ | Present invention |
| 7 | RT~500 | 25 | 500 | → | 630 × 40 | → | 50 | 4$H_2$ + 96$N_2$ | 2.11 | ○ | X | X | Comparative |

Note:
1: Underlined values are outside the range of the present invention.
2: RT indicates room temperature.
3: The oxide layer properties were evaluated using a corrosion-resistance test (two months in duration at room temperature) and an adhesion test (bending 90° to a radius of curvature of 0.5 mm) which were considered to pass (0) if no rust appears and no peeling appears, respectively.

PREFERRED EMBODIMENT 2

Slabs of a composition of 0.0032% C, 0.001% Si, 0.28% Mn, 0.20% P, 0.003% S, 0.001% AA1 and 0.0015% N by weight with the balance being Fe were heated to 1200° C., treated at a finishing temperature of 870° C., take-up temperature of 700° C. and made into 2.0 mm hot-rolled sheets. Next the sheets were cold-rolled to 0.15 mm and only the annealing conditions of Preferred Embodiment 1 were varied. The samples were annealed for 30 seconds in a nitrogen atmosphere at the various temperatures listed in Table 5 and then their properties were evaluated.

The oxidizing temperature of sample number 1 was too low, resulting in poor corrosion resistance. Samples number 4 and 6 of the invention gave superior results for both corrosion resistance and adhesion. The oxidizing temperature of sample number 3 was too high, resulting in poor adhesion. Sample number 5 had poor adhesion of the oxide layer due to oxidation at high temperature. The soaking temperature for sample number 7 was less than 650° C. so an oxide layer of only $Fe_3O_4$ was formed, resulting in poor adhesion.

As described above, only the blackening treatments which satisfy the constituent requirements of the inven-

TABLE 5

| Annealing temperature | Grain size | Hv 500 g | μ Oe | Hc Oe | Product form | Oxide layer properties | Classification |
|---|---|---|---|---|---|---|---|
| 620° C. | 8.8 | 114 | 310 | 2.01 | Good | X | Comparative example |
| 730° C. | 7.2 | 106 | 710 | 1.25 | Good | ○ | Comparative example |
| 760° C. | 6.7 | 105 | 800 | 1.16 | Good | ○ | Present invention |
| 820° C. | 6.3 | 102 | 950 | 1.10 | Good | ○ | Present invention |
| 920° C. | 5.5 | 99 | 1100 | 0.90 | Good | ○ | Present invention |
| 1000° C. | 5.3 | 99 | 1200 | 0.87 | Good | ○ | Present invention |

At annealing temperatures above 750° C., magnetic permeability of ≧750 emu and coercive force of ≦1.20 Oe were obtained. Note that the sample annealed at 620° C. did not transform to FeO so the adhesion was poor.

PREFERRED EMBODIMENT 3

Cold-rolled 0.2 mm-thick steel sheet of a composition of 0.002% C, 0.8% Si, 0.3% Mn, 0.20% P, 0.002% Al tion result in the formation of an oxide layer of satisfactory corrosion resistance and adhesion during working. Note that the oxide layer structures of samples number 1-6 are all FeO and only sample number 7 was $Fe_3O_4$. Furthermore, the target coercive force was reached in samples 3 through 6 in which the ultimate temperature was 750° C. or greater.

Thus as described above, cold-rolled steel sheet having a blackened layer of superior adhesion able to withstand working can be obtained by means of the invention, and also a television picture tube inner shielding material of high shielding performance can be obtained a the electric equipment manufacturer is able to omit the magnetic annealing and blackening treatment.

We claim:

1. An inner shielding material comprising:

a steel sheet 0.10 to 0.25 mm thick of a composition in weight percent of ≦0.005% C, ≦2.0% Si, ≦0.4% P, 0.1 to 1.0% Mn, ≦0.01% S, ≦0.01% sol.Al, ≦0.01% N and the balance Fe and residual impurities, having a hardness $H_V$(500 g) of 90 or greater and a grain size of 7 or less when measured by ferrite grain size; and a blackened layer on the surface of the steel sheet comprising FeO formed by transformation of $Fe_3O_4$ and having superior adhesion.

2. The inner shielding material of claim 1 which has a magnetic permeability of 750 emu or greater in a direct current magnetic field of 0.3 Oe and a coercive force of 1.2 Oe or less at a maximum magnetization force of 10 Oe.

3. A method of fabricating inner shielding material comprising:

preparing a slab of a composition of ≦0.005% C, ≦2.0% Si, ≦0.4% P, 0.1 ≦1.0% Mn, ≦0.01% S, ≦0.1% sol.Al, ≦0.01% N and the balance Fe and residual impurities;

fabricating a hot-rolled sheet from the slab;

cold rolling the hot-rolled sheet to a thickness of 0.10 to 0.25 mm;

continuously annealing the cold-rolled sheet; and first forming on the surface of the cold-rolled sheet an oxide film comprised of $Fe_3O_4$ by employing an oxidizing gas atmosphere over part or all of the course of the continuous annealing in which the temperature rises from 300° C. to 750° C., and then switching to a non-oxidizing gas atmosphere to carry out soaking treatment, after which cooling is effected in a non-oxidizing atmosphere;

whereby a blackened layer comprising FeO is formed.

4. The inner shielding material of claim 1 in which the blackened layer is FeO formed by transformation of 80% or more of the $Fe_3O_4$.

* * * * *